US010199131B2

(12) United States Patent
Khajeali Chaleshtori et al.

(10) Patent No.: US 10,199,131 B2
(45) Date of Patent: Feb. 5, 2019

(54) AUTOMATIC TRANSFER SYSTEM

(71) Applicants: Azim Khajeali Chaleshtori, Tabriz (IR); Alireza Farajollahi, Tabriz (IR)

(72) Inventors: Azim Khajeali Chaleshtori, Tabriz (IR); Alireza Farajollahi, Tabriz (IR)

( * ) Notice: Subject to any disclaimer, the term of this patent is extended or adjusted under 35 U.S.C. 154(b) by 0 days.

(21) Appl. No.: 15/592,183

(22) Filed: May 10, 2017

(65) Prior Publication Data

US 2017/0243666 A1 Aug. 24, 2017

Related U.S. Application Data

(60) Provisional application No. 62/340,543, filed on May 24, 2016.

(51) Int. Cl.
*G21K 5/08* (2006.01)

(52) U.S. Cl.
CPC ..... *G21K 5/08* (2013.01)

(58) Field of Classification Search
USPC ..... 250/453.11
See application file for complete search history.

(56) References Cited

U.S. PATENT DOCUMENTS 3,506,825 A * 4/1970 Hartmann ..... A23L 3/263 250/303
3,676,675 A * 7/1972 Ransohoff ..... G21K 5/02 198/712
5,314,072 A * 5/1994 Frankel ..... B07C 5/3408 209/44.1
7,832,185 B2 * 11/2010 Mastio ..... A61L 2/082 250/492.3
8,497,488 B2 * 7/2013 Lejeune ..... A61L 2/087 250/455.11

FOREIGN PATENT DOCUMENTS

KR 101268448 B1 6/2013

OTHER PUBLICATIONS

X Li, An automated fast transfer system at the research reactor Munich, Nuclear Instruments and Methods in Physics Research Section A: Accelerators, Spectrometers, Detectors and Associated Equipment, vol. 522, Issue 3, Apr. 21, 2004, pp. 470-476.
S. S. Ismail, A New Automated Sample Transfer System for Instrumental Neutron Activation Analysis, Journal of Automated Methods and Management in Chemistry, vol. 2010 (2010), Article ID 389374, 8 pages.

* cited by examiner

*Primary Examiner* — Phillip A Johnston
(74) *Attorney, Agent, or Firm* — NovoTechIP International PLLC

(57) ABSTRACT

A sample transfer system for nuclear irradiation and a method of automatically irradiating sample containers is disclosed. The sample transfer system includes a conduit which may define a passage for transferring a plurality of sample containers, an input assembly which may be configured to allow the plurality of sample containers to pass through the conduit in a predefined order, and an exposure assembly which may be configured to receive the sample containers via the conduit and rotate the sample containers in front of a radiation source.

16 Claims, 8 Drawing Sheets

AUTOMATIC TRANSFER SYSTEM

CROSS-REFERENCE TO RELATED APPLICATION

This application claims the benefit of priority from U.S. Provisional Patent Application No. 62/340,543, filed on May 24, 2016, and entitled "AUTOMATIC PORTABLE IRRADIATION SYSTEM," which is incorporated herein by reference in its entirety.

TECHNICAL FIELD

The present disclosure generally relates to methods and devices for sample transfer, particularly to methods and devices for automatic sample transfer, and more particularly to methods and devices for automatic sample transfer for nuclear irradiation.

BACKGROUND

Nuclear irradiation is a process in which an object or a sample may be exposed to nuclear radiation. The radiation source may be a neutron source, such as a nuclear reactor or a nuclear accelerator. Nuclear irradiation may have different applications, one such example including Neutron Capture Therapy (NCT), and in particular Boron Neutron Capture Therapy (BNCT), which has been used in cancer treatment.

Boron Neutron Capture Therapy (BNCT) may be performed at a facility with a specially designed nuclear reactor or at, hospitals that have an accelerator-based neutron source. A beam of epithermal neutrons is provided by the nuclear reactor or the accelerator-based neutron source and may penetrate the samples that are placed in front of the neutron source.

Traditionally, placing the samples in front of a nuclear reactor in, order to be exposed to a specific dose of nuclear radiation may be done manually by operators. However, there are problems associated with the manual transfer and placement of the samples, including but not limited to the threat of being exposed to the nuclear radiations, as well as unstable irradiation due to stability issues associated with nuclear reactors.

There is a need in the art for methods and devices to improve the transfer process of the samples to be irradiated. There is further a need in the art for an automatic and portable transfer system for transferring the samples in front of nuclear radiation automatically, which is capable of exposing the samples to a homogeneous dose of nuclear radiation.

SUMMARY

This summary is intended to provide an overview of the subject matter of this patent, and is not intended to identify essential elements or key elements of the subject matter, nor is it intended to be used to determine the scope of the claimed implementations. The proper scope of this patent may be ascertained from the claims set forth below in view of the detailed description below and the drawings.

In one general aspect, the present disclosure is directed to a method of irradiating samples using an irradiation system. The method includes releasing at least a first sample container from an initial position, receiving the first sample container in an irradiation position, the irradiation position being disposed below the initial position, and exposing the first sample container to a radiation source, thereby irradiating the first sample container.

The above general aspect may include one or more of the following features. For example, the method may further include rotating the first sample container while the first sample container is being irradiated and/or releasing a second sample container from the initial position. In some cases, the initial position and the irradiation position may be linked together by a substantially vertical conduit, where the first sample container moves from the initial position to the irradiation position through the conduit. The method may also include releasing a second sample container from the initial position; and moving a first gate into a first slit, the first slit being formed in a first portion of the conduit, the first gate blocking the passage of the second sample container through, the first portion of the conduit. In addition, the method may involve removing the first gate from the first slit, thereby permitting the second sample container passage through the first portion of the conduit. The method may also include moving a second gate into a second slit, the second slit being formed in a second portion of the conduit, the second portion being disposed below the first portion, the second gate blocking the passage of the second sample container through the second portion of the conduit. In some cases, the second gate may be removed from the second slit, thereby permitting the second sample container passage through the second portion of the conduit. The method may include releasing the irradiated sample container from the irradiation position; and receiving the irradiated sample container in a sample storage area, the sample storage area being disposed lower relative to the irradiation position. In addition, the method may include using a controller associated with the irradiation system to adjust a number of sample containers to be received by the irradiation position.

In another general aspect, the present disclosure is directed to a sample transfer system for nuclear irradiation. The sample transfer system includes a conduit defining a passage for transfer of at least a first sample container from at least an initial position to an irradiation position, an input assembly configured to allow the first sample container to pass through the conduit in a predefined order, and an exposure assembly configured to receive the first sample container via the conduit and rotate the sample containers during exposure to a radiation source.

The above general aspect may include one or more of the following features. For example, the system may be configured to close and open a first portion of the passage in the conduit. In addition, the input assembly may include a first gate configured to open and close the conduit; and a second gate disposed above the first gate, the second gate being configured to hold one or more sample containers while the first gate is opened. The input assembly may further include a motor; an actuator coupled to the motor, where the actuator is configured to convert a rotational motion of the motor to a linear motion of the first gate; and a mechanism connected to the actuator, wherein the mechanism is configured to transfer motion of the actuator to the second gate and thereby close the conduit while the first gate is opened. The mechanism may be further configured to transfer motion of the actuator to the second gate and thereby open the conduit while the first gate closes. In some cases, the exposure assembly rotates each received sample container for a predetermined amount of time. In addition, each sample container may be attached to an engagement member. The exposure assembly may further comprise a first mechanism configured to engage and rotate the sample container, the first mechanism including a first motor and at least one gear coupled to the first motor, where the at least one gear is configured to engage with the engagement member of the sample container. The exposure assembly may further comprise a second mechanism configured to displace the first mechanism, the second mechanism including a second motor and an actuator coupled to the second motor, where the actuator is configured to actuate the first mechanism to be displaced thereby to be engaged with the engagement member. The system may further comprise a sample storage area, where the sample storage area comprises a lead-coated chamber.

Other systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
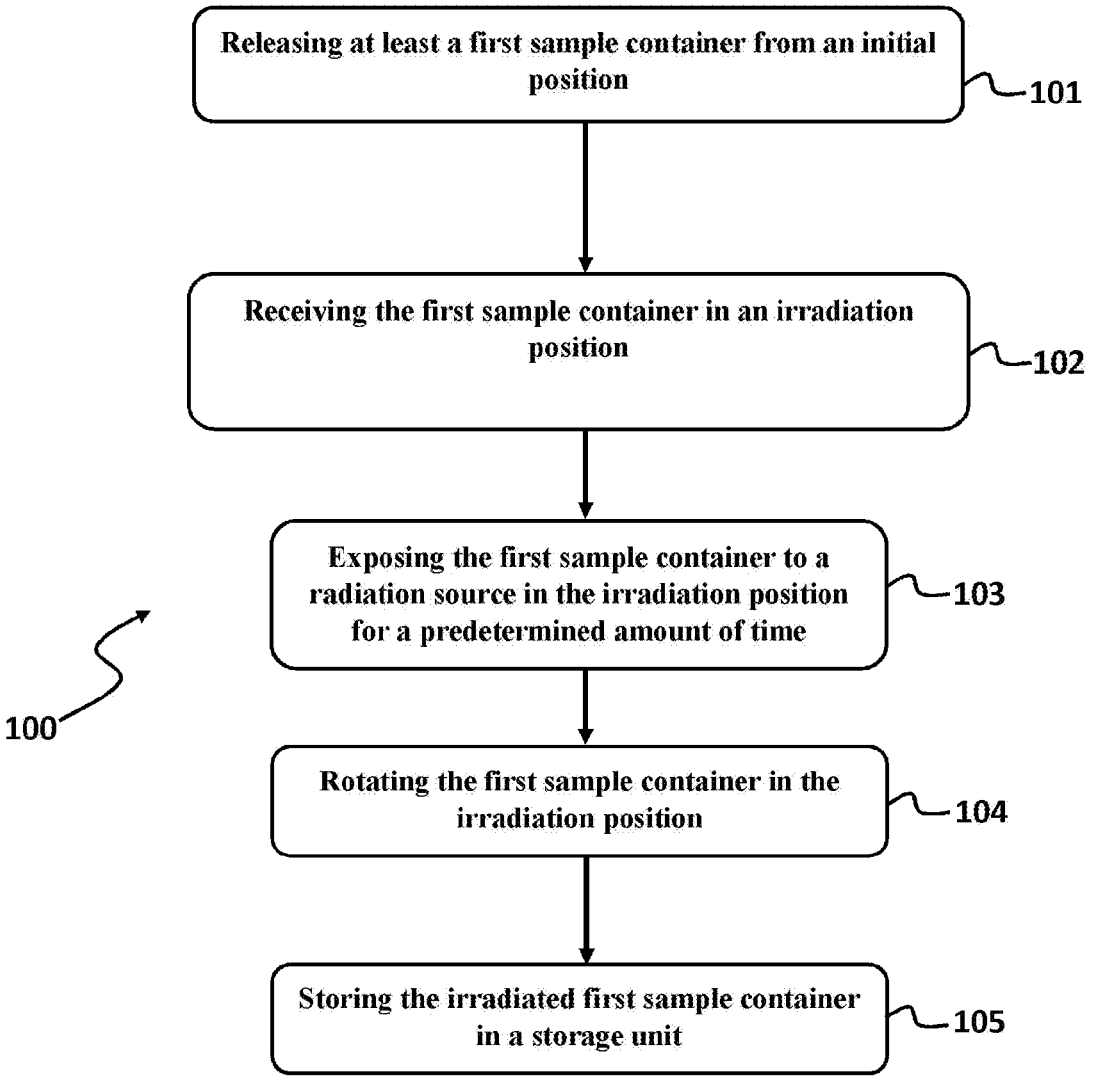
FIG. 1 depicts a schematic flowchart of a transfer method for an irradiation transfer system, according to one or more implementations of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

Disclosed methods and devices herein are directed to a sample transfer system configured to transfer a number of samples from a distant first position to an irradiation position in front of a radiation source, such as a neutron source, or other radiation sources. The samples to be irradiated (i.e., exposed to the radiation emitted by the radiation source) may be placed inside sample containers or vials. The sample transfer system may be capable of rotating the sample containers in front of the radiation source in order for the samples to receive a substantially homogeneous amount of nuclear radiation for a predefined amount of exposure time. In some implementations, the sample transfer system may be portable and automatic. In one implementation, the sample transfer system may include a conduit, an input assembly, an exposure assembly and a controller. The conduit provides the sample containers with a vertical or substantially vertical passage to facilitate the transfer of samples from the first position defined by the input assembly to the irradiation position defined by the exposure assembly by the force of gravity. In some implementations, the input assembly may be configured to open and close a path defined by the conduit in order to send the sample containers to the irradiation position in a predefined order. In one implementation, the input assembly may send a second sample container to the irradiation position after a first sample has received irradiation for a predetermined amount of time. Alternatively, the input assembly may send a set of predefined number of sample containers to the irradiation position. The time of irradiation for each sample may be specified by a user.

The input assembly may be disposed at an adjustable distant first position from the exposure assembly, and the input assembly may be configured to receive a number of samples with a predefined order and sending the samples to the exposure assembly utilizing the force of gravity. The samples inside the sample containers, once placed in the irradiation position, may be rotated in front of the radiation source by the exposure assembly in order for each sample to receive substantially uniform radiation from the radiation source. After a predefined period of time, the sample containers may be allowed to exit the exposure assembly towards a lead-coated chamber in order to be stored. In some implementations, the sample containers are automatically removed from the irradiation position and placed at a distant position after the predefined period of time has passed.

The methods and system described herein provide an automatic and portable transfer system for transferring the samples in front of nuclear radiation, as well as a system that is capable of exposing the samples to a homogeneous dose of nuclear radiation. FIG. 1 illustrates a flowchart of an implementation of a transfer method 100 for transferring a number of samples from a distant initial position to an irradiation position near a radiation source, such as a nuclear reactor, accelerators, or other radiation sources. Method 100 includes a first step 101 of releasing at least a first sample container from an initial position, a second step 102 of receiving the first sample container in an irradiation position, the irradiation position being disposed below the initial position, and a third step 103 of exposing the first sample container to a radiation source, thereby irradiating the first sample container.

In other implementations, there may be optional further steps, as represented by a fourth step 104 in which the first sample container is rotated while in the irradiation position, and, a fifth step 105 where the first sample container is moved to a storage unit.

In other implementations, the method can include additional steps or features. For example, the method can further comprise rotating the first sample container while the first sample container is being irradiated, releasing a second sample container from the initial position, releasing a second sample container from the initial position, and/or moving a first gate into a first slit, the first slit being formed in a first portion of the conduit, the first gate blocking the passage of the second sample container through the first portion of the conduit.

Still other implementations can include removing the first gate from the first slit, thereby permitting the second sample container passage through the first portion of the conduit, moving a second gate into a second slit, the second slit being formed in a second portion of the conduit, the second portion being disposed below the first portion, the second gate blocking the passage of the second sample container through the second portion of the conduit, and/or removing the second gate from the second slit, thereby permitting the second sample container passage through the second portion of the conduit.

In some implementations, the method can involve releasing the irradiated sample container from the irradiation position and receiving the irradiated sample container in a sample storage area, the sample storage area being disposed lower relative to the irradiation position, and/or using a controller associated with the irradiation system to adjust a number of sample containers to be received by the irradiation position.

Furthermore, in different implementations, the method can comprise first step of sending a number of sample containers from the initial position to the irradiation position via a substantially vertical path, utilizing the force of gravity (where the initial position is higher relative to the irradiation position); a second step of exposing the sample containers to radiations received from the radiation source in the irradiation position for a predetermined amount of time; a third step of concurrently rotating the sample containers in the irradiation position; and an optional fourth step of storing irradiated sample containers in a storage unit. It should be understood that in an exemplary implementation, the third step can describe the ongoing rotation of the sample container while the radiation exposure of the second step is occurring (e.g., the rotation occurs concurrently with the exposure of the sample container to the irradiation). This can optimize the uniform exposure of the contents of the sample container to the radiation in some cases. However, in other implementations, the third step can describe one or more rotation(s) of the sample container that occur during the period the sample container is in the irradiation position (whether or not the radiation source is active/on or off). In other words, in different implementations, the rotation can be substantially continuous during the irradiation of the sample container, while in some other implementations, there may be multiple partial rotations, where the sample container is turned partway, paused, and turned partway again. In some cases, the partial rotation may occur when the sample container is in the irradiation position, but is not being irradiated. In this case, once the sample container is rotated to the desired position, the radiation source can irradiate the sample. In other implementations, the partial rotation may occur while the sample container is being irradiated. In addition, in some implementations, the first step may include sending the sample containers to the irradiation position in a predefined order, for example one sample at a time, or a set of predefined number of samples at a time. Furthermore, in some implementations of the second step, each sample may be exposed to radiation for a specific amount of time for that sample.

Figure 2:
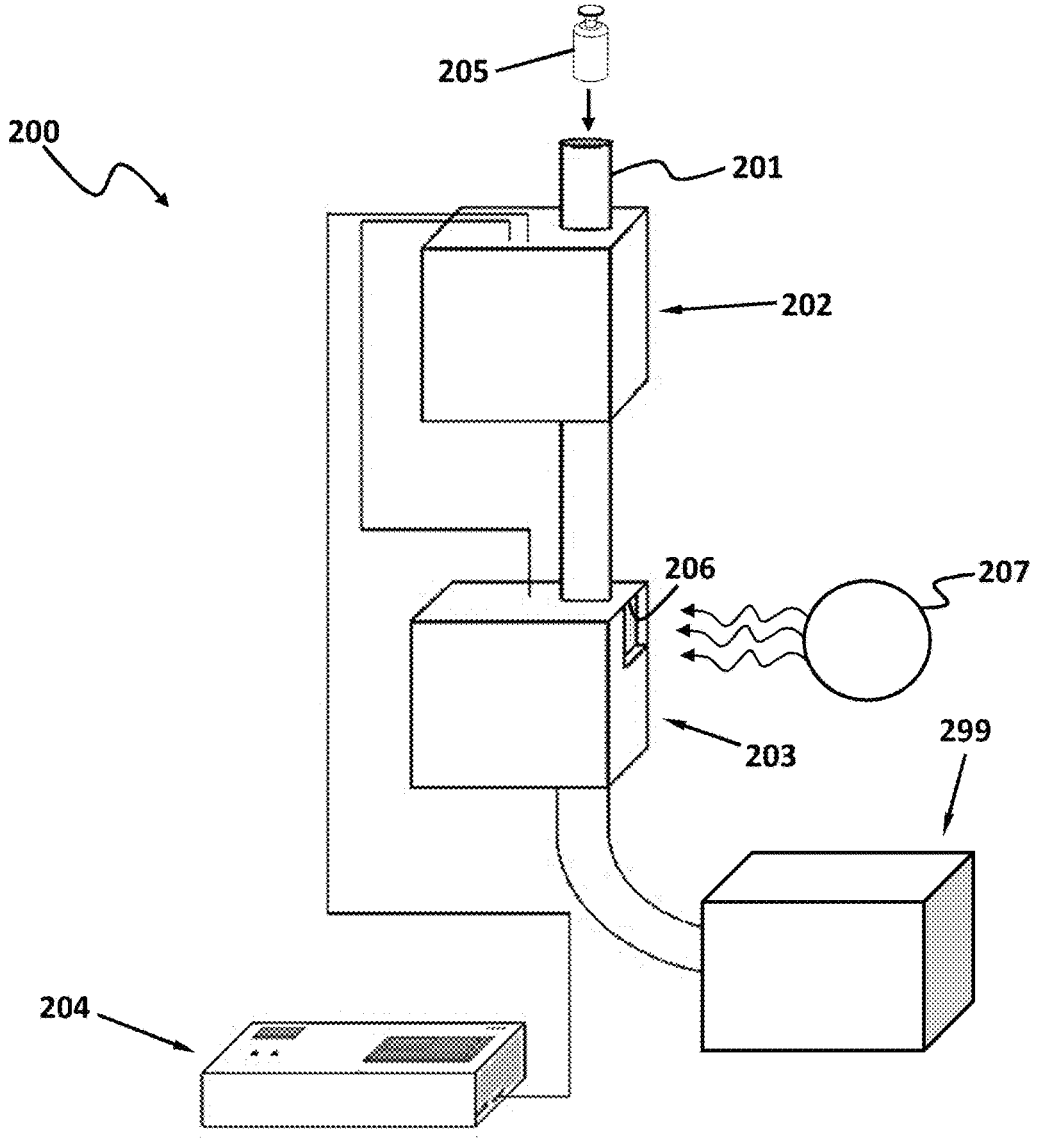
FIG. 2 depicts a schematic view of an irradiation transfer system, according to an implementation of the present disclosure.

Referring now to FIG. 2, an illustration of a sample transfer apparatus 200 that may be configured for use with one or more methods described herein is presented. In one implementation, the sample transfer apparatus 200 may include a substantially vertical conduit ("conduit") 201, an input assembly 202, an exposure assembly 203, a controller 204, and optionally a sample storage unit 299.

As shown in FIG. 2, conduit 201 may provide a substantially vertical path through which one or more sample containers, such as sample container 205, may be sent to the irradiation position defined by exposure assembly 203. The sample to be irradiated may be placed inside a sample container 205. Sample container 205 may be placed inside conduit 201. In one implementation, a number of sample containers may be placed or inserted, one on top of another, inside of conduit 201 (see for example FIG. 4B below). Input assembly 202 may intercept the path defined by conduit 201. Input assembly 202 may be configured for allowing sample containers to pass through conduit 201 in a predefined order. In one implementation, input assembly 202 may be configured to allow a predefined number of sample containers to pass through conduit 201 while holding any remaining sample containers that have been placed in conduit 201. In some implementations, input assembly 202 may be configured to allow a predefined number of sample containers to pass through conduit 201 by opening the path ("open state") defined by conduit 201. Similarly, input assembly 202 may be configured to hold or store the remaining sample containers by closing or blocking a portion of the path ("closed state") defined by conduit 201.

According to an implementation, after placing the sample containers inside conduit 201, the exposure time for each sample may be specified via controller 204. Controller 204 may be configured to communicate, transmit commands, or otherwise cause input assembly 202 to allow the passage of each sample container based on the specified exposure time for each sample container. As noted above, once sample containers are allowed to pass through conduit 201 (where the conduit is in the open state), the sample containers may fall or drop towards exposure assembly 203 due to the force of gravity. It should be understood that while in some implementations the sample containers can fall in a substantially free manner, with little or no friction or other hindrance, in other implementations, the passage define by conduit 201 can include a diameter that snugly receives and conducts the sample container at a speed slower than that of a free fall. Similarly, in some implementations, the passage defined by conduit 201 can include bumps, irregularities, texturing, protuberances, cushioning, or other features that interact with the exterior of the sample container and can facilitate a smooth, stable, and/or secure pathway for the sample container.

With further reference to FIG. 2, in different implementations, a sample container conducted from input assembly 202 to exposure assembly 203 via conduit 201 may be received in the irradiation position defined inside exposure assembly 203. In one implementation, the irradiation position is associated with a position near an opening 206 in exposure assembly 203. In some implementations, the opening 206 can be directly in front of or otherwise proximal to a radiation source 207. In one implementation, once a sample container is received or otherwise disposed in the irradiation position, controller 204 may receive a signal from a touch, pressure, force, motion or other type of sensor that may indicate the presence of a sample container in the irradiation position. Upon receiving the signal, controller 204 may communicate, command, or otherwise cause exposure assembly 203 to rotate the sample container while the sample container is in the irradiation position. A benefit from this feature may include but is not limited to a substantially homogeneous dose of radiation being received by the sample inside the sample container. The irradiation of each sample may be carried out for a predetermined exposure time. In some implementations, the predetermined exposure time can be the same for each sample container in a series, while in other implementations, the predetermined exposure time can vary for two or more sample containers.

In some implementations, once each sample container has received radiation from radiation source 207 for the predetermined exposure time, exposure assembly 203 may allow or facilitate the transfer of the irradiated sample container towards sample storage unit 299. In some implementations, sample storage unit 299 can comprise, for example, a lead-coated chamber that may be a preserving container coated with a shield of lead. In other implementations, sample storage unit 299 can comprise any protective container or holding area configured to provide radiation shielding.

Figure 3:
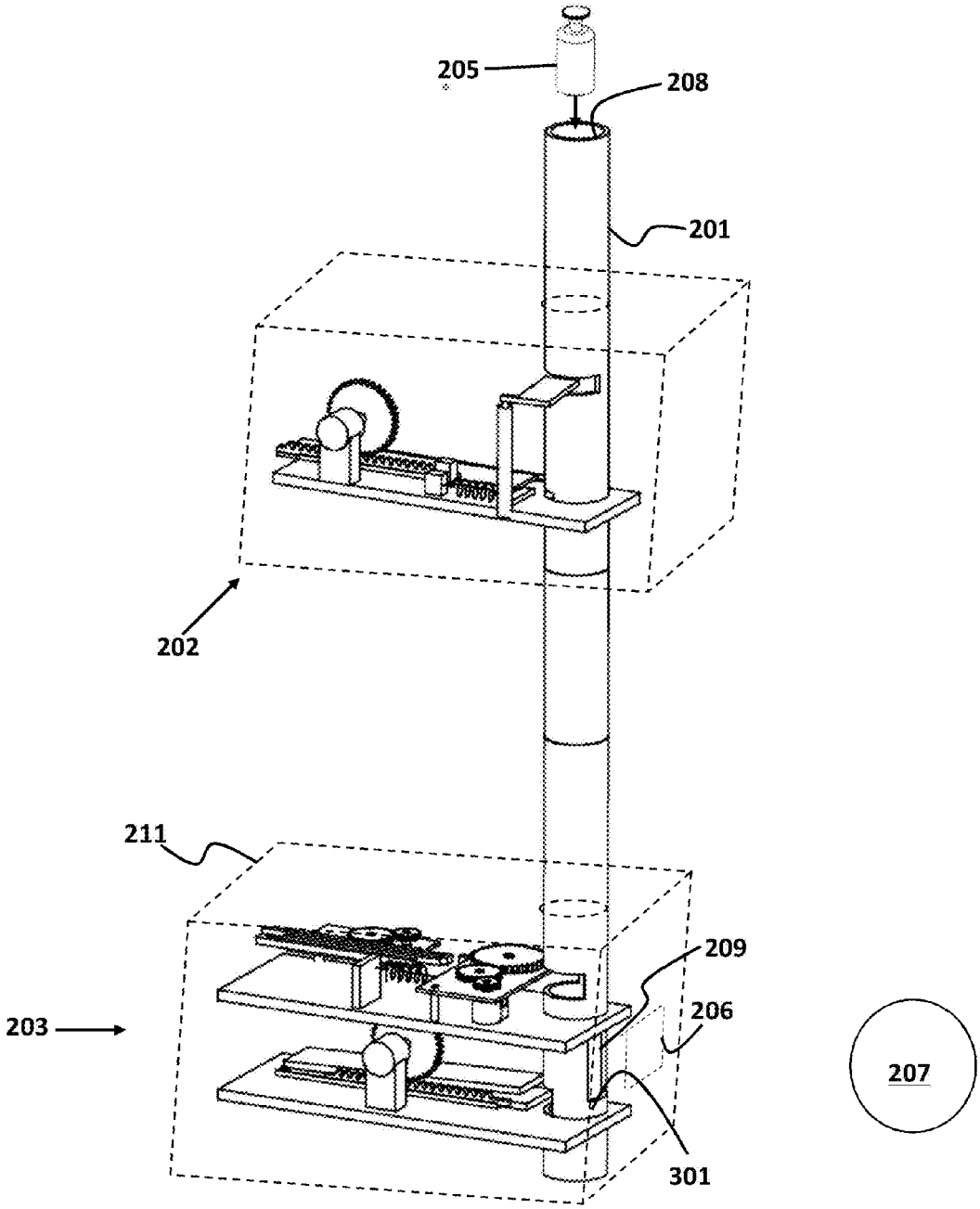
FIG. 3 depicts a perspective view of an irradiation transfer system, according to an implementation of the present disclosure.
Figure 4A:
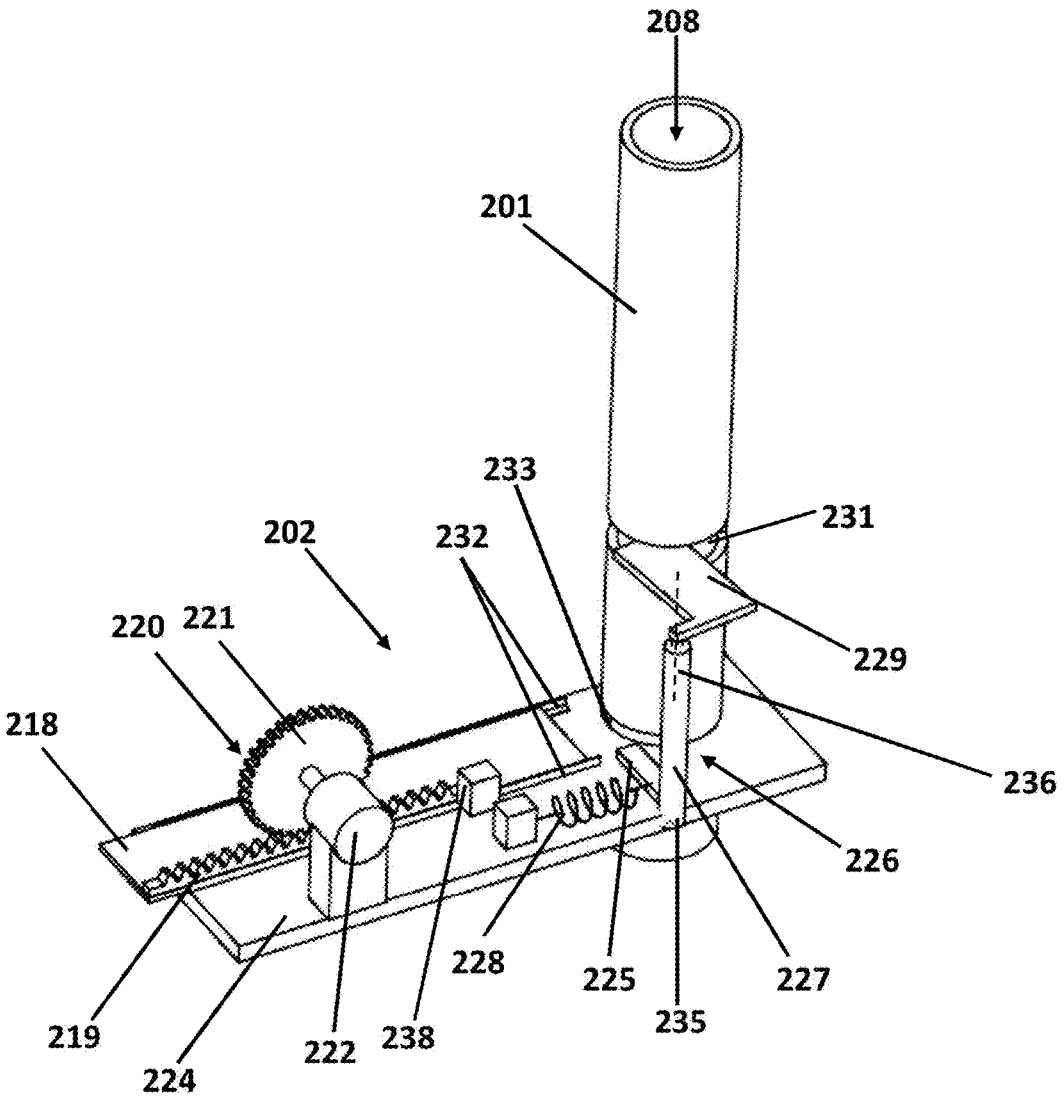
FIG. 4A depicts a schematic perspective view of an input assembly, according to an implementation of the present disclosure.

Referring now to FIGS. 3 and 4A, conduit 201 may define a path 208 with rectangular or circular cross sections or other shapes that may be sized for allowing a generally free movement of sample container 205 through path 208. In one implementation, the conduit 201 may be constructed in separate sections that may then be connected to one another to form the passage. In some cases, the separate sections can be integrally joined, while in other cases, one or more of the sections can be modular, and removably attached or connected for ease of assembly and disassembly. Furthermore, in some implementations, the length of the conduit 201 may be adjustable. For example, a user may extend the length of the conduit 201 to use the system 200 from a preferred safe distance from the nuclear radiation source 207. In addition, a user may adjust the length of the conduit 201 to provide a shorter or longer passageway for receiving a smaller or larger set of sample containers in some implementations.

As shown in FIG. 4A, sample containers may initially be conducted down path 208 from a position immediately above input assembly 202, adjacent to or above a first gate 218. Conduit 201 may be mounted or arranged vertically or include a vertical component, with an orientation that allows for movement of the sample container 205 by the force of gravity. Referring to FIGS. 3 and 4A, there may be a second slit 231 and a first slit 233 defined and provided on the wall of conduit 201 in front of the input assembly 202. The first slit 233 may be defined for the movements of the first gate 218 and the second slit 231 may be defined for the movements of the second gate 229.

Referring to FIGS. 2 and 3, in one example implementation, radiation from the irradiation source 207 may reach the sample container 205 through opening 209, which may be defined on the wall of conduit 201 in a position in front of the irradiation source 207. The sample container 205 may be placed inside the conduit 201 in front of the opening 209 during the simultaneous process of rotation and irradiation. The opening 209 may be aligned with the opening 206 in order to make a window and allow the neutron beam of the irradiation source 207 to pass through and reach the sample container 205 placed in an irradiation position 301 near opening 209.

Referring to FIG. 3, in one example implementation, the conduit 201 may be mounted as an adjustable passage with some portions to be connected. The input assembly 202 may be constructed as a portable unit mounted in front of a portion of the conduit 201. The input assembly 202 may be placed in a safe distance from the radiation source 207. In another implementation the conduit 201 may be mounted in front of the radiation source 207 while the input assembly 202 and the exposure assembly 203 may be mounted thereon.

Referring now to FIG. 4A, an isolated view of a portion of the system including the input assembly 202 is provided for purposes of clarity. In some implementations, input assembly 202 may be activated to allow a predetermined number of the sample containers 205 to pass through the conduit 201 by displacing the first gate 218. In addition, a mechanism 226 may be activated during this time which is configured to hold remaining sample containers (if any) in their places in a vertical queue (shown in FIG. 4B) within the conduit 201. As shown in FIG. 4A, in one implementation, the input assembly 202 may include: a first gate 218 aligned with a first slit 233, the first gate 218 being configured to be displaced, thereby opening or closing path 208; a second gate 229 disposed above the first gate 218, the second gate 229 being configured to hold the remaining sample containers 205 during periods in which the first gate 218 is opened; a motor 222 configured to provide required power and torque; an actuator 220 coupled with the motor 222, the actuator 220 configured to convert the rotational movement of the motor 222 to the linear movement of the first gate 218; and a mechanism 226 connected with the actuator 220, wherein the mechanism 226 may be configured to transfer the movement of the actuator 220 to the second gate 229. This can allow the second gate 229 to hold the remaining sample containers 205 in their queue while the first gate 218 is opened and also allow the second gate 229 to release the remaining samples while the first gate 218 is closed.

FIG. 4A can be understood to depict one example implementation of the input assembly 202 as it is configured to transfer a predefined number of the sample containers in a predefined order, while holding any remaining samples in place. With reference back to FIG. 2, in some implementations, the controller 204 may activate the input assembly 202 and trigger a displacement of the first gate 218, in order to allow the movement of the sample containers 205 through the passageway in the conduit.

Figure 4B:
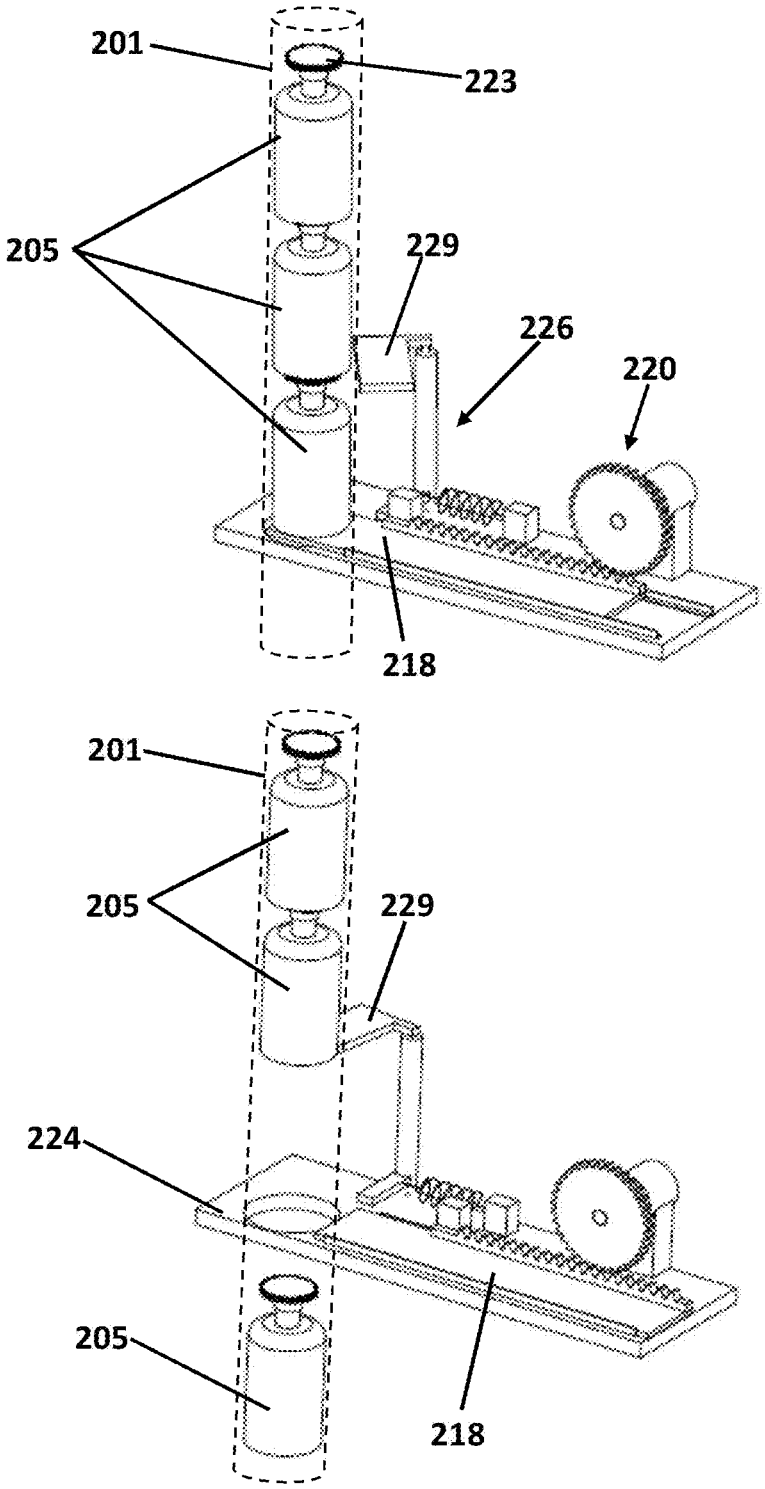
FIG. 4B depicts two schematic perspective views of an input assembly with sample containers thereon in an opened and closed position, according to an implementation of the present disclosure.

Referring to FIG. 4B, it can be seen that the mechanism 226 may be linked with the actuator 220. Therefore the mechanism 226 may transfer the linear movement of the actuator 220 to the second gate 229 to allow the second gate 229 to hold the remaining sample containers 205, while the first gate 218 is opened to permit a predefined number of sample containers 205 to pass through the first gate 218 (lower figure in FIG. 4B). As shown in the upper figure of FIG. 4B, when the first gate 218 closes the conduit 201, the second gate 229 may rotate, slide, or otherwise move away from the conduit 201, thereby releasing any remaining sample containers 205. As a result, a predefined number of the sample containers 205 may be allowed to pass the second gate 229 and rest upon or be placed on the first gate 218 in a type of vertical queue. In this state a first sample container may fall on the first gate 218 while a predefined number of additional sample containers 205 are positioned upon or directly above the first sample container. In this state there may be no engagement of the second gate 229 with the sample containers 205. In different implementations, the timing of the movements of the first gate 218 and the second gate 229 may be adjusted by regulating the displacement course of the actuator 220. In one implementation, the movement of the actuator 220 may be regulated at least in part by a sensor system and the controller 204.

As shown in FIG. 4B, in some implementations, the mechanism 226 may be connected to an actuator 220 of the input assembly 202 and may be configured to move in a substantially synchronous way relative to the actuator 220. The mechanism 226 may also be configured to help hold an adjacent sample container 205 in place, such that any remaining sample containers 205 in the queue above are held in place and prevented from further downward movement. When the first gate 218 has moved and the conduit 201 is in the open state, a predefined number of the sample containers 205 may be passed towards the next position. In the implementation shown in FIG. 4B, one sample container 205 may pass at a time. The sample containers 205 which pass through the first gate 218 may subsequently drop towards the exposure assembly 203.

Thus, as the sample container(s) fall downward, the exposure assembly 208 may receive each of the sample containers 205. Once received, the sample containers 205 may be rotated in front of the opening 207 in order to be uniformly exposed to a predetermined amount of nuclear irradiation. In some implementations, the input assembly 202 may facilitate the order and timing of transfer of the sample containers 205, and the exposure assembly 203 may provide the sample containers 205 with a position to be simultaneously rotated and exposed to the radiation.

For purposes of clarity, additional details regarding the operation of the first gate 218 is provided with reference again to FIG. 4A. In some implementations of the current disclosure, a mounting plate 224 may be placed in front of the conduit 201, the mounting plate 224 extending in a plane that is in alignment with the first slit 233, and providing a mounting base for different parts of the input assembly 202. The mounting plate 224 may be placed in front of or adjacent to the first slit 233 in order to allow the movements of the first gate 218 inside or through the first slit 233. In some implementations, a set of two parallel rails 232 may be disposed or mounted on the mounting plate 224 in substantial alignment with the first slit 233, thereby defining a linear track for displacements of the first gate 218. The first gate 218 may be disposed on or associated with the two rails 232, and be capable of movement along the defined linear track. Thus, the two rails 232 can provide a mechanism by which the first gate 218 may slide in to and out of the first slit 233 in order to open or block the path 208. The motor 222 is mounted on the mounting plate 218 and may be activated by the controller 204 to provide the power for the movement of the first gate 218. The actuator 220 may be considered a type of converting mechanism, which may convert the rotational power of the motor 222 to the linear movement of the first gate 218.

In different implementations, the actuator 220 may comprise various structures. For example, actuator 220 can comprise a ball screw mechanism, a threaded rod-nut set, or other types of mechanical actuators, hydraulic actuators, pneumatic actuators, piezoelectric actuators, electro-mechanical actuators, linear motors, telescoping linear actuators, or other type of actuator. In the implementation of FIG. 4A, the actuator 220 comprises a rack and pinion mechanism, wherein the pinion 221 may be coupled with the output shaft of the motor 224 and the rack 219 may be attached to the first gate 218. The rotational movements of the motor 222 may be transferred to the rotation of the pinion 221 as a driver gear which is meshed with the rack gear 219. As a result, the rack gear 219 may be linearly moved, and as the rack 219 is attached to the first gate 218, the rack 219 and the first gate 218 may be moved along the defined track by the rails 232. Consequently the first gate 218 may either be moved through the opening provided by the first slit 233 to block the path 208 or move out of the first slit 233 and open the path 208.

In some implementations, as shown in FIGS. 4A and 4B, the mechanism 226 may be mounted on the mounting plate 224, connected to the actuator 220, and configured to transfer the movement of the first gate 218 to the second gate 229. In other words, the mechanism 226 may adjust the movement of the second gate 229 in accordance with the movement of the first gate 218. The movement of the second gate 229 may be substantially synchronous with the movement of the first gate 218. This can allow the second gate 229 to close the upper portion of the path 208 and hold the remaining sample containers 205 while the lower section of the path 208 is opened by the first gate 218, allowing a predefined number of samples to pass through the conduit 201. Similarly, when the first gate 218 is closed, the second gate 229 may release the sample containers 205. Therefore, in some implementations, the position of the second gate 229 may be determined relative to the position of the first gate 218. Thus, as the first gate 218 moves, the mechanism 226 can ensure that the second gate 229 slides in to or out of the second slit 231 in accordance with the position of the first gate 218 in the system.

Further details on the mechanism 226 are provided, with reference again to FIG. 4A. As shown in FIG. 4A, in one implementation, the mechanism 226 may include a first link 225 and a second link 227. The second link 227 may be rotatably mounted on the mounting plate 224 making a pivot 235 around which the mechanism 226 may be rotated. The first link 225 may be attached to the second link 227 and rotatable therewith around the pivot 235. The second link 227 may be mounted vertically with respect to the mounting plate 224 and parallel to the axis of the conduit 201. The first link 225 may be placed in a plane parallel to that of the mounting plate 224 and attached to the second link 227. It can be seen that the linear movement of the first gate 218 may be transferred to the first link 225 when an appendage 238 engages with the first link 225. The appendage 238 may be attached to the first gate 218 and can be forced to move into contact with the first link 225 during the linear movement of the first gate 218. The interaction of the appendage 238 and the first link 225 may cause the first link 225 to rotate around the pivot 235, in turn causing the second link 227 to rotate around an axis of rotation 236. The second gate 229 may be in alignment with the second slit 231 and attached to the second link 227 perpendicularly from one end and may rotate therewith around the axis 236 in order to open or close the path 208 associated with the second slit 231. Furthermore, a spring 228 may be attached to the mechanism 226 that is configured to produce the required restoring force for the mechanism 226 to return to its initial position during the reverse displacement of the first gate 218. The spring 228 may cause the second link 227 to rotate in the opposite direction around the axis 236 in order to reverse the opening or closing action of the second gate 229.

Figure 5A:
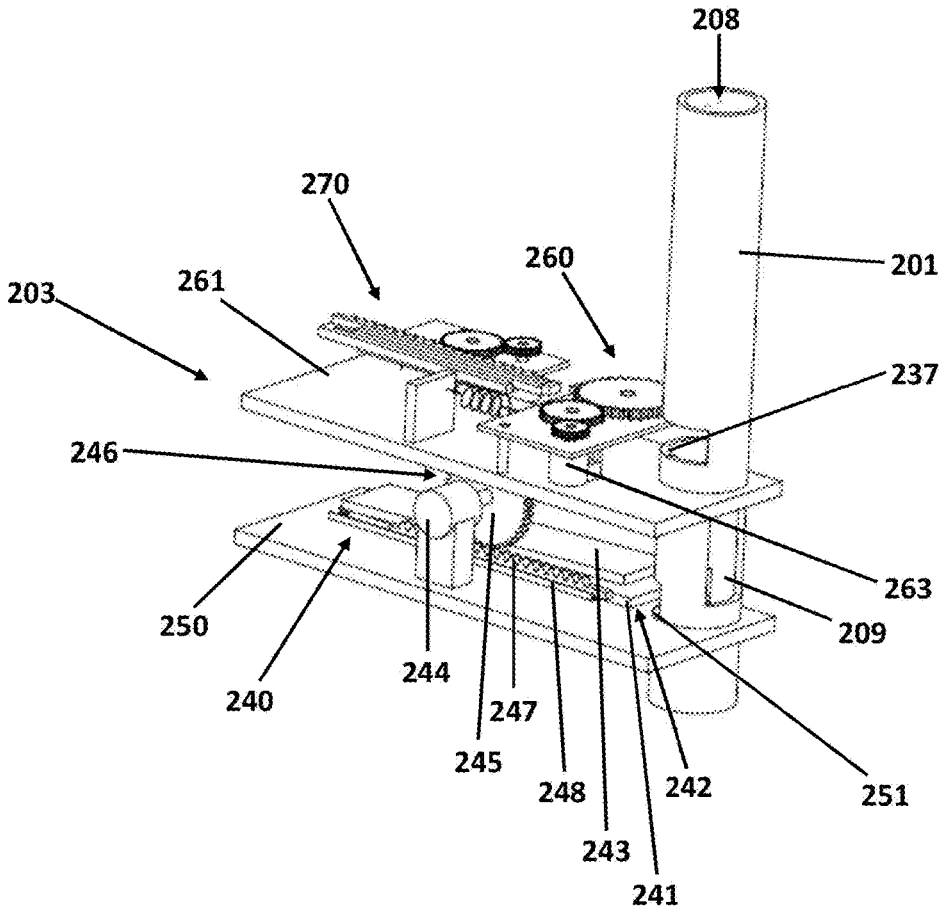
FIG. 5A depicts a schematic perspective view of an exposure assembly, according to an implementation of the present disclosure.

Referring now to FIG. 5A, a schematic view of an implementation of the exposure assembly 203 is presented. As noted earlier, the exposure assembly 203 may be configured to receive a predefined number of the sample containers 205 via the conduit 201 and rotate the received sample containers 205 in front of the irradiation source 216. In FIG. 5A, it can be seen that associated, with, a portion of the conduit 201 placed in front of or near the exposure assembly 203, two additional slits (a fourth slit 237 and a third slit 251) are formed. The fourth slit 237 permits a first mechanism 260 to engage or disengage the sample container 205. Furthermore, a third gate 242 may move into and out of the third slit 251 in order to open or close the path 208.

In some implementations, the exposure assembly 203 is configured to rotate the sample containers 205 in front of the opening 209 and simultaneously expose the sample containers 205 to the nuclear radiation. As best represented in the depictions of FIGS. 5A-5C, in different implementations, the exposure assembly 203 may include: a third gate 242 configured to move into and out of the third slit 251, allowing the path 208 to be opened or closed, a first mechanism 260 configured to engage and disengage with sample containers and rotate one or more sample containers during irradiation, a second mechanism 270 configured to displace the first mechanism 260 to allow engagement with an engagement member 223 of the sample containers 205 (see FIG. 5C), as well as a third mechanism 240 configured to displace the third gate 242.

Figure 5B:
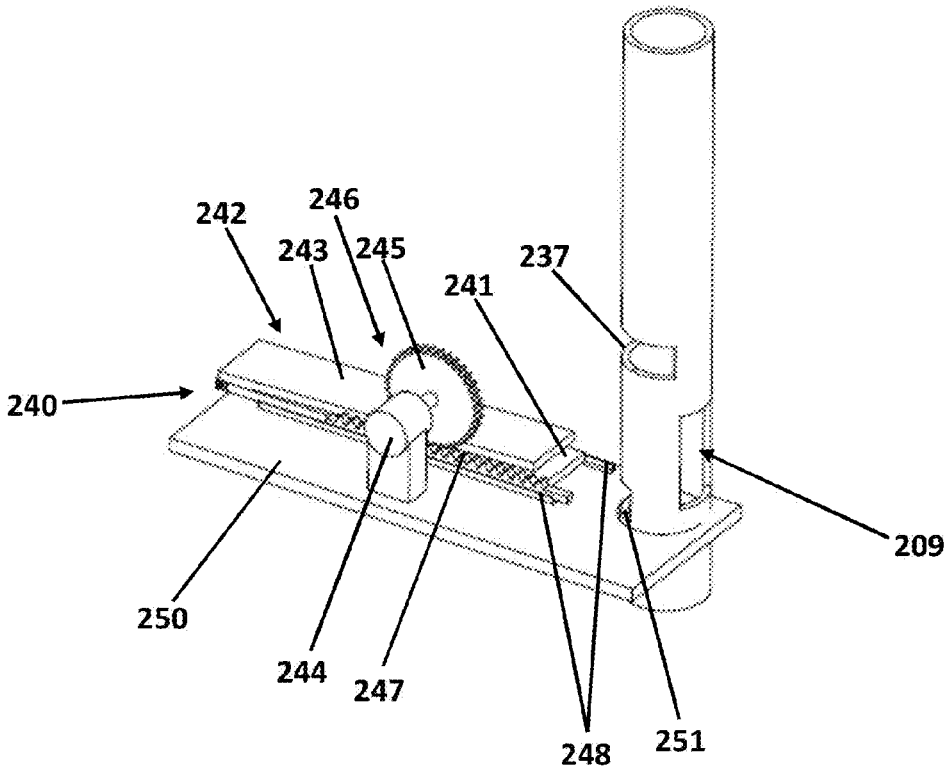
FIG. 5B depicts a schematic perspective view of a third mechanism of an exposure assembly, according to an implementation of the present disclosure.
Figure 5C:
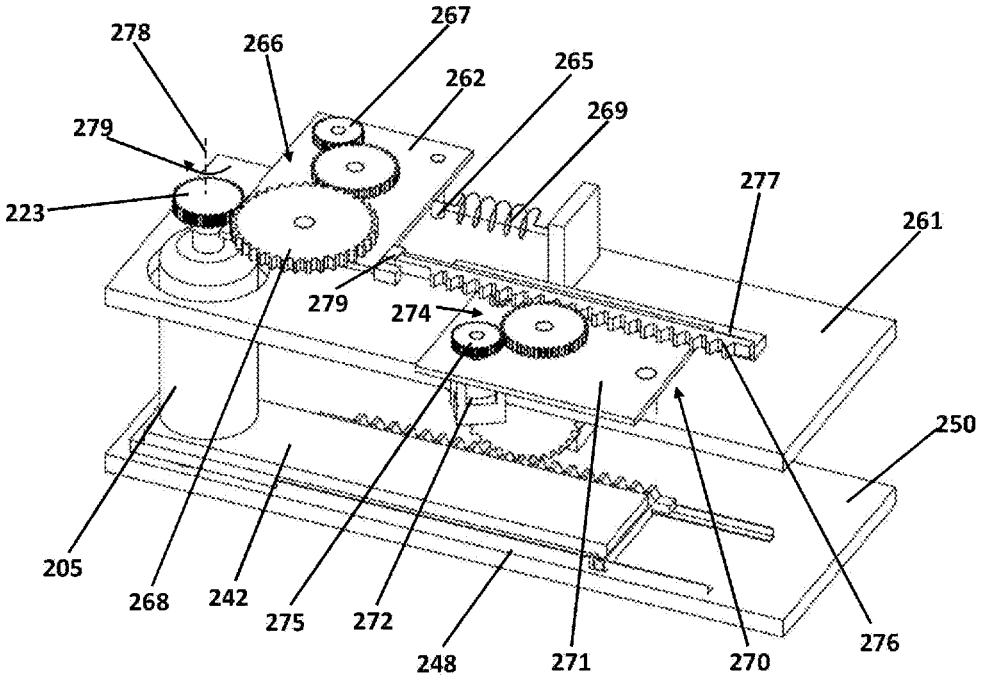
FIG. 5C depicts a schematic perspective view of first and second mechanisms of an exposure assembly, according to one or more implementations of the present disclosure.

Further details regarding the operation of the exposure assembly are provided now with reference to FIGS. 5A, 5B, and 5C. In one implementation, the first mechanism 260 may be displaced to contact the head of the sample container 205 and rotate the sample container 205 around an axis 278. In some implementations, the first mechanism 260 may be engaged and disengaged to the sample containers 205. The engagement member 223 may be placed on the head of the sample containers 205 and facilitate engagement with the first mechanism 260. The controller 204 (see FIG. 2) may then activate the second mechanism 270 to displace the first mechanism 260 and move the first mechanism 260 into alignment with the fourth slit 237, where it can engage or disengage with the head of the sample containers 205. In some implementations, the first mechanism 260 may be mounted in front of the fourth slit 237 on a mounting plate 261. The mounting plate 261 may be attached to the housing of the assembly in one implementation. The third slit 251 may be provided on the wall of the conduit 202 below the fourth slit 237. The third gate 242 may be placed in front of the third slit 251 and aligned therewith on a mounting plate 250. The third gate 242 may displace in and out of the fourth slit 237 crossing the conduit 202 to open or close the path 208. The third mechanism 240 may be mounted on the mounting plate 250. The mounting plate 250 may be placed in front of the third slit 251 and attached to the housing of the assembly. The distance between the fourth slit 237 and third slit 251 may be adjusted according to the dimensions and number of the samples to be exposed in each interval.

Referring again to FIGS. 5A-5C, various samples may be placed inside the sample containers 205. The sample containers 205 may be in a shape to facilitate substantially free or smooth movement along the path 208 of the conduit 201. Therefore the shape of the sample containers 205 may be dependent on the shape of the conduit 201. In one example implementation, for the cylindrical conduit 201, the sample containers 205 may comprise a cylindrical or spherical shape with a head or cover. The head of the sample containers 205 may be disposed near the top portion of the container. The engagement member 223 may be disposed upon or above the head of the sample containers 205. The exposure assembly 203 may be engaged to the sample containers 205 through the engagement member 223 and rotate the sample containers 205 around the vertical axis of rotation 278. In, one example implementation, the head of the sample container 205 comprises the engagement member 223. In another example the engagement member 223 may be a gear placed on a head of the sample container 205.

Referring to FIGS. 5A, 5B and 5C, in different implementations, the first mechanism 260 may include: a movable plate 262 configured to provide the mounting places for parts of the first mechanism 260, a first motor 263 (visible in FIG. 5A) mounted on the movable plate 262 and configured to provide the required rotational power; a gear set 266 which may include at least a pinion gear 267, coupled with the first motor 263 and configured to transfer the rotational power of the first motor 263 to the rotation of the sample containers 205; and a spring 269 attached to the movable plate 262 from one side and to the mounting plate 261 from the other side, the spring 269 being configured to provide the restoring force for the movable plate 261 to return to its initial position. The pinion 267 may be coupled with the output shaft of the first motor 263 and may also be engaged with the gear 268. The motor 263 and the gear set 266 may be mounted on the movable plate 262.

In one implementation, the movable plate 262 may be mounted on the mounting plate 261 by a pivoting pin 265. The pin 262 may provide a pivot around which the whole set, including the first motor 263, the gear set 266 and the movable plate 262, may be rotated. Through the rotation of the movable plate 262, the first mechanism 260 becomes engaged with the head of the sample containers 205 (or the engagement member 223). In other implementations, the movable plate 262 may be moved along a linear track defined by a set of two rails 248 by an actuator, such as the actuators described herein with respect to FIGS. 4A and 4B. This system provides a means of rotating the sample containers 205. Due to the pivoting of the movable plate 262, the gear 268 can engage with the engagement member 223. The sensor system 205 may adjust the amount of the pivoting and sense the engagement of the gear 268 with the engagement member 223. The controller 204 may force the first motor 263 to rotate the pinion 267. The rotation may be transferred to the sample containers 205 through the gear 268 subsequently in an adjustable rotational speed. As a result the sample container 205 may rotate around the axis 278 in front of the opening 207. Referring to FIGS. 5A and 5C, in one implementation, the second mechanism 270 may be configured to displace the first mechanism 260 to engage with and rotate the sample containers 205.

An example of the third mechanism 270 is shown in FIG. 5C. As depicted in FIG. 5C, third mechanism 270 may include: a second motor 272 configured to provide the rotational power; an actuator 274 configured to convert the rotational movement of the motor 272 to a linear movement; and a base plate 271 configured to provide the mounting places for different parts of the third mechanism 270.

In some implementations, the actuator 274 may comprise a linear actuator, such as a rack-pinion set, including at least a pinion 275 and a rack gear 276. The pinion 275 may be coupled with the output shall of the motor 272 and engage, either directly or through intermediary gears, with the rack gear 276. The rack gear 276 may be movable linearly on a slotted guide 277. The slotted guide 277 may be attached to the base plate 271 and the rack gear 276 may be movable thereon inside the slot. The rotational movement of the second motor 272 may be converted to the linear movement of the rack gear 276 through the rotation of the pinion 275. The rack gear 276 may then linearly displace in the slotted guide 277. An appendage 279 may be attached to the front side of the rack gear 276. During the movement of the rack gear 276 the appendage 279 may contact the movable plate 262 of the first mechanism 260 and exert a force in order to displace the first mechanism 260. Other implementations of the actuator 274 may include a ball screw mechanism, a thread-nut mechanism, or other actuators as described herein with respect to FIGS. 4A and 4B.

Some implementations of the third mechanism 270 may include an embedded motor and actuator set which may be placed inside the first mechanism 260, replacing the pivoting pin 265. Through the activation of the motor-actuator by the controller 204 the displacement of the first mechanism 260 may be possible.

In different implementations the controller 204 may activate the second mechanism 270 to displace the first mechanism 260. The second mechanism 270 may hold the first mechanism 260 that is engaged with the sample container 205 during the irradiation process. Upon completion of irradiation, the controller 204 can direct the second mechanism 270 to return to its initial position. As a result, the exerted force may be removed and the first mechanism 260 may be pulled back by the spring 269. The spring 269 may provide the restoring force for the first mechanism 260 to return to its initial position through the rotation of the movable plate 262 around the pivoting pin 265.

Following irradiation, the irradiated sample containers 205 may be transferred or otherwise moved to the lead-coated chamber of the sample storage unit due to their weight. The controller 204 may cause the third mechanism 240 to displace the third gate 242 in order to open the lower portion of path 208 leading towards the lead-coated chamber.

Further detail regarding the third mechanism 240 is also provided with reference to FIGS. 5A and 5B. In different implementations, the third mechanism 240 may be activated by the controller 204 to displace the third gate 242 in or out of the third slit 251 in order to open or close the path 208. Referring to FIGS. 5A and 5B, the third mechanism 240, in one implementation, may include: a mounting plate 250 mounted in front of the third slit 251 and attached to the housing of the assembly and configured to provide a mounting area or region; a third motor 244 which may be mounted on the mounting plate 250 and provide rotational power; an actuator 246 which may be connected to the third motor 244 and is configured to convert the rotational movement of the third motor 244 to the linear movement of the third gate 242; and a set of two parallel rails 248 which may be mounted on the mounting plate 250 and be configured to define a track for displacing the third gate 242.

The actuator 246 may be implemented by different mechanisms like a ball screw actuator, thread-nut mechanism and so on, or any of the actuators described herein. Referring to FIGS. 5A and 5B, in one implementation, the actuator 246 may include a rack-pinion gear set 246, where the pinion 245 is coupled with the output shaft of the third motor 244 and engaged with the rack gear 247. The rack gear 247 may be attached to the third gate 242 and configured to receive the rotational power of the third motor 244 through the pinion 245 and translate along the track defined by the rails 248 in order to move the third gate 242 linearly in or out of the third slit 251.

In other implementations, a touch sensor may also be embedded on the third gate 242. This sensor may be associated with the sensor system 205, and can be configured to sense the receipt of the sample container 205 and inform the controller 204 when the sample container is in the designated position. In addition, in some implementations, the third gate 242 may include a lower plate 241 and an upper plate 243. The lower plate 241 may be placed on the rails 248 and the upper plate 243 may be placed at an angle with respect to the lower plate 241, attaching to the lower plate 241 from its proximal end and capable of rotating around the proximal end. The touch sensor may be disposed between the two plates (lower plate 241 and upper plate 243). The sensor system 205 may inform the control system 204 when the samples are received on the third gate 242. Upon receiving the signal from the sensor system 205, the controller 204 may cause the second mechanism 270 to displace the first mechanism 260, such that the first mechanism 260 is engaged to the respective sample container 205 through the engagement member 223 and initiate rotation of the sample container 205.

Following the irradiation process, the sensor system 205 may inform the controller 204 that irradiation has been completed. The controller 204 may then cause the second mechanism 270 to displace the first mechanism 260 and disengage the first mechanism 260 from the sample container 205. At this time the rotation of the sample container 205 can be discontinued, and the sample container 205 may be ready to move to the lead-coated chamber. The sensor system 205 may then inform the controller 204 that the rotation has ceased, and the controller 204 can activate the third mechanism 240. The controller 204 may cause the third mechanism 240 to displace the third gate 242 along the track defined by the rails 248. The controller 204 may further activate the motor 243 to rotate the pinion 245. The pinion 245 may then drive the rack gear 247 linearly to open the path 208. Subsequently the path 208 may be opened and the irradiated sample container 205 or a predefined number of the irradiated sample containers 205 may move or slide downward as a result of their respective weights towards the lead-coated chamber. The third gate 242 may then be driven by the rack gear 247 to return to its initial position in the third slit 251 and close the path 208 again. The system may be ready for use again with new sample containers.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method of irradiating samples using an irradiation system, the method comprising:

releasing at least a first sample container from an initial position:

receiving the first sample container in an irradiation position, the irradiation position being disposed below the initial position, wherein the initial position and the irradiation position are linked together by a substantially vertical conduit, and wherein the first sample container moves from the initial position to the irradiation position through the conduit;

exposing the first sample container to a radiation source, thereby irradiating the first sample container; and rotating the first sample container while the first sample container is being irradiated.

2. The method of claim 1, further comprising releasing a second sample container from the initial position.

3. The method of claim 1, further comprising:

releasing a second sample container from the initial position; and moving a first gate into a first slit, the first slit being formed in a first portion of the conduit, the first gate blocking the passage of the second sample container through the first portion of the conduit.

4. The method of claim 3, further comprising removing the first gate from the first slit, thereby permitting the second sample container passage through the first portion of the conduit.

5. The method of claim 4, further comprising moving a second gate into a second slit, the second slit being formed in a second portion of the conduit, the second portion being disposed below the first portion, the second gate blocking the passage of the second sample container through the second portion of the conduit.

6. The method of claim 5, further comprising removing the second gate from the second slit, thereby permitting the second sample container passage through the second portion of the conduit.

7. The method of claim 1, further comprising:

releasing the irradiated sample container from the irradiation position; and receiving the irradiated sample container in a sample storage area, the sample storage area being disposed lower relative to the irradiation position.

8. The method of claim 1, further comprising using a controller associated with the irradiation system to adjust a number of sample containers to be received by the irradiation position.

9. A sample transfer system for nuclear irradiation, the sample transfer system comprising:

a conduit defining a passage for transfer of at least a first sample container from at least an initial position to an irradiation position;

an input assembly configured to allow the first sample container to pass through the conduit in a predefined order; and an exposure assembly configured to receive the first sample container via the conduit and rotate the sample containers during exposure to a radiation source, the first sample container attached to an engagement member, the exposure assembly comprising a first mechanism configured to engage and rotate the sample container, the first mechanism including a first motor and at least one gear coupled to the first motor, wherein the at least one gear is configured to engage with the engagement member of the sample container.

10. The system according to claim 9, further comprising a control system configured to close and open a first portion of the passage in the conduit.

11. The system according to claim 9, wherein the input assembly includes:

a first gate configured to open and close the conduit; and a second gate disposed above the first gate, the second gate being configured to hold one or more sample containers while the first gate is opened.

12. The system according to claim 11, wherein the input assembly further includes:

a motor;

an actuator coupled to the motor, wherein the actuator is configured to convert a rotational motion of the motor to a linear motion of the first gate; and a mechanism connected to the actuator, wherein the mechanism is configured to transfer motion of the actuator to the second gate and thereby close the conduit while the first gate is opened.

13. The system according to claim 12, wherein the mechanism is further configured to transfer motion of the actuator to the second gate and thereby open the conduit while the first gate closes.

14. The system according to claim 9, wherein the exposure assembly rotates each received sample container for a predetermined amount of time.

15. The system according to claim 9, wherein the exposure assembly further comprises a second mechanism configured to displace the first mechanism, the second mechanism including a second motor and an actuator coupled to the second motor, wherein the actuator is configured to actuate the first mechanism to be displaced thereby to be engaged with the engagement member.

16. The system according to claim 9, further comprising a sample storage area, wherein the sample storage area comprises a lead-coated chamber.

* * * * *